US009929511B2

(12) United States Patent
Lynch et al.

(10) Patent No.: US 9,929,511 B2
(45) Date of Patent: Mar. 27, 2018

(54) SHIELDED HIGH DENSITY CARD CONNECTOR

(71) Applicant: Intel Corporation, Santa Clara, CA (US)

(72) Inventors: John M. Lynch, Forrest Grove, OR (US); Chong Richard Zhao, West Linn, OR (US); Xiang Li, Portland, OR (US); Donald T. Tran, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/074,094

(22) Filed: Mar. 18, 2016

(65) Prior Publication Data

US 2017/0271818 A1 Sep. 21, 2017

(51) Int. Cl.
*H01R 12/72* (2011.01)
*H01R 13/6461* (2011.01)
(Continued)

(52) U.S. Cl.
CPC ..... *H01R 13/6461* (2013.01); *H01R 12/737* (2013.01); *H01R 12/75* (2013.01);
(Continued)

(58) Field of Classification Search
CPC .. H01R 12/72; H01R 13/658; H01R 13/6585; H01R 13/6586; H01R 23/6873; H01R 12/73
(Continued)

(56) References Cited

U.S. PATENT DOCUMENTS 5,024,609 A * 6/1991 Piorunneck ..... H01R 12/721 439/60
5,035,631 A 7/1991 Piorunneck et al.
(Continued)

FOREIGN PATENT DOCUMENTS

JP 2001196128 A 7/2001

OTHER PUBLICATIONS

"International Application Serial No. PCT/US2017/018200, International Search Report dated May 18, 2017", 3 pgs.
(Continued)

*Primary Examiner* — Abdullah Riyami
*Assistant Examiner* — Justin Kratt
(74) *Attorney, Agent, or Firm* — Schwegman Lundberg & Woessner, P.A.

(57) ABSTRACT

An example electronic assembly for securing an electronic card. In some forms, the electronic assembly further includes a printed circuit board. The electronic assembly includes a housing having a first set of electrical contacts and a second set of electrical contacts. The housing is configured to receive the electronic card between the first and second set of electrical contacts. The housing further includes a third set of electrical contacts and a fourth set of electrical contacts. The housing is configured to receive the electronic card between the third and fourth set of electrical contacts. A ground shield is positioned between at least one of the first and third set of electrical contacts and the second and fourth set of electrical contacts. In some forms, the ground shield may be positioned between both the first and third set of electrical contacts and the second and fourth set of electrical contacts.

7 Claims, 5 Drawing Sheets

(51) Int. Cl.

| | |
|---|---|
| ***H01R 12/73*** | (2011.01) |
| ***H01R 12/75*** | (2011.01) |
| *H01R 13/658* | (2011.01) |
| *H01R 13/6586* | (2011.01) |
| *H01R 12/50* | (2011.01) |
| *H01R 13/6585* | (2011.01) |

(52) U.S. Cl.
CPC ..... *H01R 12/72* (2013.01); *H01R 12/73* (2013.01); *H01R 13/658* (2013.01); *H01R 13/6585* (2013.01); *H01R 13/6586* (2013.01); *H01R 23/6873* (2013.01)

(58) Field of Classification Search
USPC ..... 439/62, 637, 607.32, 607.14, 607.05, 31
See application file for complete search history.

(56) References Cited

U.S. PATENT DOCUMENTS

| | | | | |
|---|---|---|---|---|
| 5,239,748 | A * | 8/1993 | Hamilton | H05K 1/117 29/843 |
| 7,637,783 | B2 * | 12/2009 | Sasaoka | H01R 43/16 439/637 |
| 8,033,871 | B2 * | 10/2011 | Pocrass | H01R 23/10 439/344 |
| 8,177,585 | B2 * | 5/2012 | Pocrass | H01R 23/10 439/344 |
| 2002/0173177 | A1 | 11/2002 | Korsunsky et al. | |
| 2012/0156936 | A1 * | 6/2012 | Wu | H01R 13/648 439/626 |
| 2012/0156940 | A1 * | 6/2012 | Wu | H01R 13/6461 439/660 |
| 2012/0156941 | A1 * | 6/2012 | Wu | H01R 13/6585 439/660 |
| 2013/0309906 | A1 * | 11/2013 | De Geest | H01R 13/646 439/607.31 |
| 2013/0316585 | A1 | 11/2013 | Mcgrath | |
| 2014/0220820 | A1 | 8/2014 | Mongold et al. | |
| 2015/0340817 | A1 * | 11/2015 | Li | H01R 13/6598 439/62 |

OTHER PUBLICATIONS

"International Application Serial No. PCT/US2017/018200, Written Opinion dated May 18, 2017", 8 pgs.

* cited by examiner

SHIELDED HIGH DENSITY CARD CONNECTOR

BACKGROUND

The current paths in integrated circuits and other electronic assemblies that include processors are continually being required to handle ever-increasing amounts of current in order power the processors. Processors typically require more power in order to operate at higher frequencies and to simultaneously perform numerous logic and memory operations.

Many processors are electrically connected to electronic cards using conventional card connectors that typically include a single row of contacts per side (or two total rows of contacts). This relatively limited number of contacts reduces the number of connections that can be made between the card and another electronic component (e.g., a processor mounted on a printed circuit board).

Increasing the density of the number of electrical connections between the card and the processor may be desirable for a variety of electronic design reasons. In addition, card connectors must be able to readily receive cards and maintain signal integrity once the cards are mated with the card connector.

There are also typically geometric constraints associated with attaching the card connector to another electronic component (e.g., a printed circuit board). In addition, card connectors need to permit easy access for ready removal and insertion of the card to/from the card connector.

DETAILED DESCRIPTION

The following detailed description references the accompanying drawings. Like numerals describe substantially similar components throughout each of the drawings. Other embodiments may be used, and structural, logical, and electrical changes made. The integrated circuit described herein can be manufactured, used, or shipped in a number of positions and orientations.

The electronic assemblies described herein may be implemented in a number of different embodiments, including an electronic package, an electronic system, a computer system, one or more methods of fabricating an integrated circuit, and one or more methods of fabricating an electronic assembly that includes the integrated circuit. The elements, materials, geometries, dimensions, and sequence of operations can all be varied to suit particular packaging requirements.

The connectors described herein may include ground shielding between differential pairs of signal conductors that are electrically connected to the card once the card is inserted into the connector. The grounding shield may reduce crosstalk between the differential pairs of signal contacts. Reducing crosstalk between the differential pairs of signal contacts may promote signal integrity between the card and another electronic component (e.g., a processor).

The electronic assemblies that include the card connectors described herein may include a printed circuit board that has grounding pads which are connected to a ground shielding in the card connector. The electrical connection between the grounding shield and ground pads in the printed circuit board may promote better signal integrity, especially when there is a compact and high density arrangement of signal conductors between the card and the card connector. In addition, the electronic assemblies described herein may permit additional rows of contacts to be incorporated into the electronic assemblies without increasing the overall footprint of the card connector on the printed circuit board.

Figure 1:
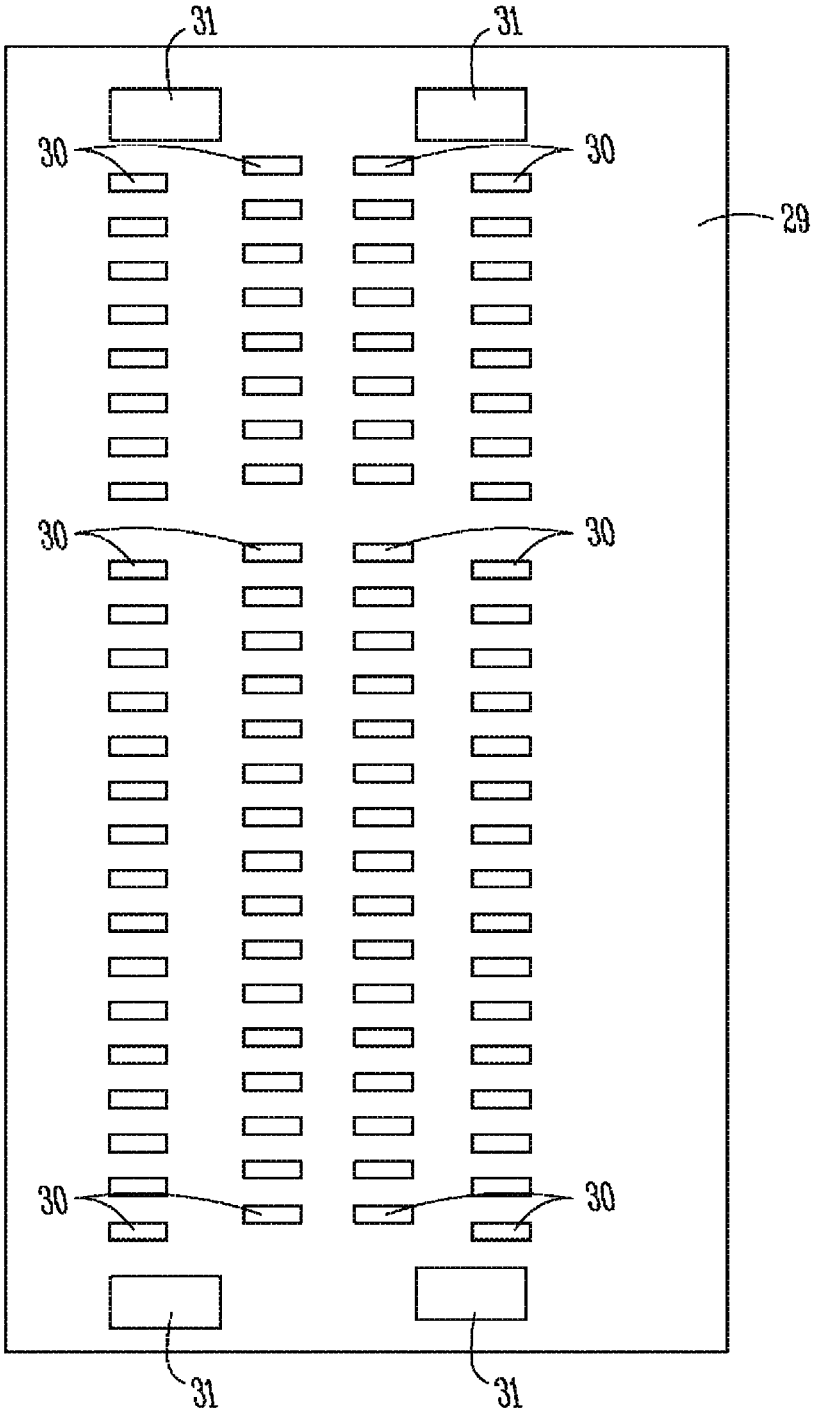
FIG. 1 is a schematic top view of a printed circuit board.
Figure 2:
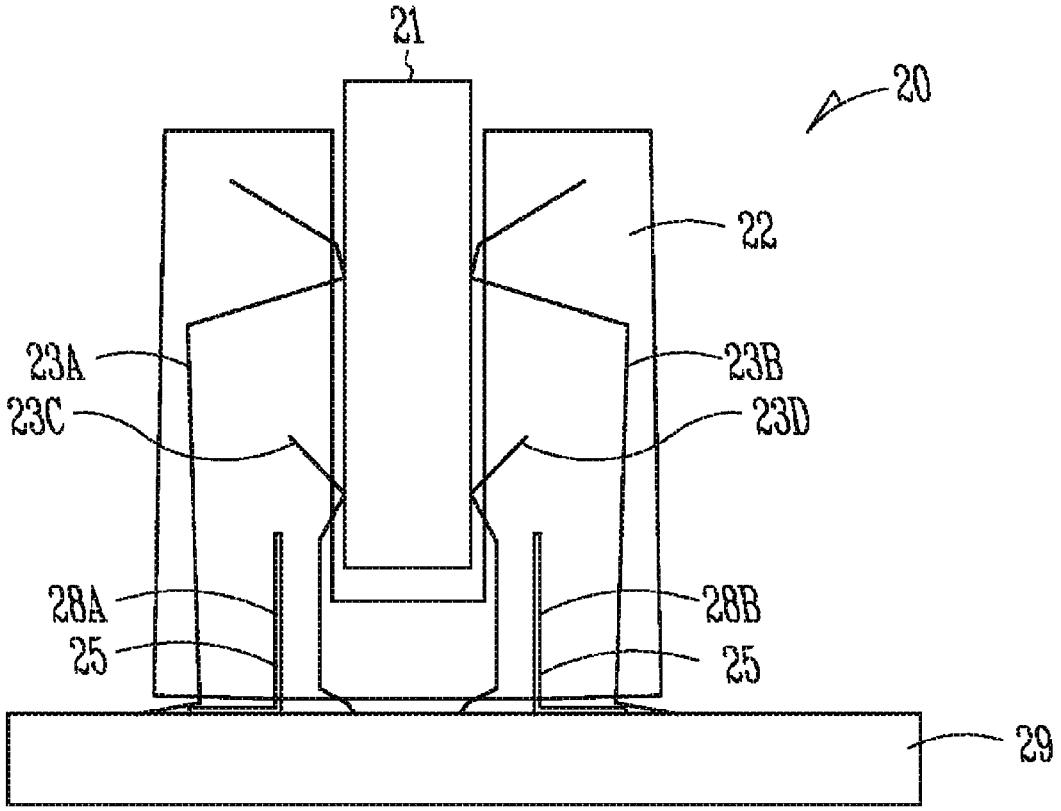
FIG. 2 is an end view of an example electronic assembly that includes the printed circuit board shown in FIG. 1.

FIG. 1 is a schematic top view of a printed circuit board 29. FIG. 2 is an end view of an example electronic assembly 20 for securing an electronic card 21. In some forms, the electronic assembly 20 further includes the printed circuit board 29 shown in FIG. 1.

Figure 3:
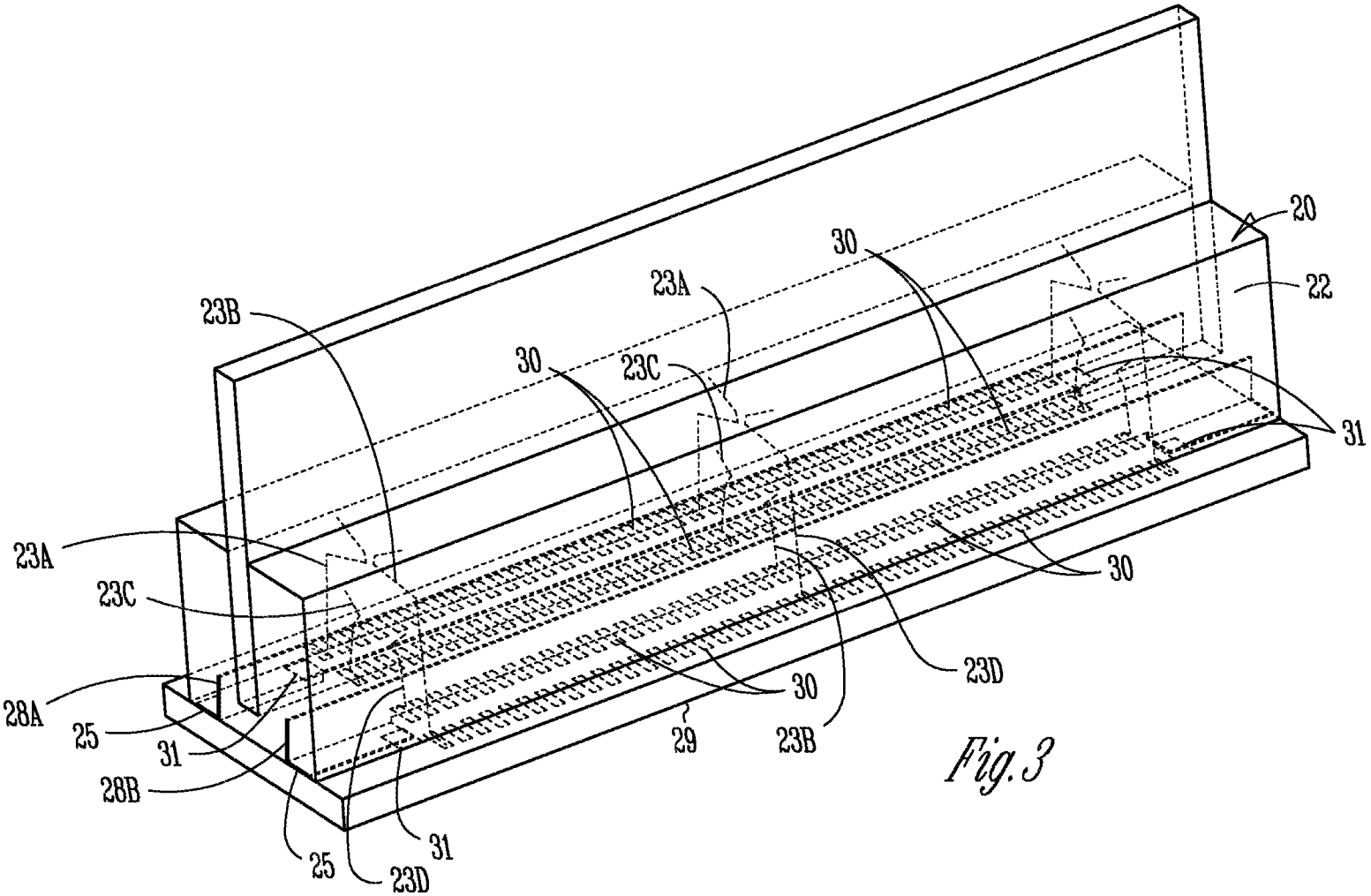
FIG. 3 is a perspective view illustrating the electronic assembly shown in FIG. 2.

FIG. 3 is a perspective view illustrating the electronic assembly 20 shown in FIG. 2. The electronic assembly 20 includes a housing 22 having a first set of electrical contacts 23A and a second set of electrical contacts 23B. The housing 22 is configured to receive the electronic card 21 between the first and second set of electrical contacts 23A, 23B.

The housing 22 further includes a third set of electrical contacts 23C and a fourth set of electrical contacts 23D. The housing 22 is configured to receive the electronic card 21 between the third and fourth set of electrical contacts 23C, 23D.

A ground shield 25 is positioned between at least one of the first and third set of electrical contacts 23A, 23C and the second and fourth set of electrical contacts 23B, 23D. It should be noted that in some forms the ground shield 25 may be positioned between both the first and third set of electrical contacts 23A, 23C and the second and fourth set of electrical contacts 23B, 23D.

The first and second set of electrical contacts 23A, 23B may take a variety of forms. In some forms, the first and second set of electrical contacts 23A, 23B are able to provide a compressive force to the electronic card 21 when the electronic card 21 is positioned between the first and second set of electrical contacts 23A, 23B. In addition, the first and second set of electrical contacts 23A, 23B may provide an electrical connection between the electronic card 21 and the printed circuit board 29.

The type of electronic card 21 that is included in the electronic assembly 20 will depend on the application where the electronic assembly 20 is to be used (among other factors). It should be noted that the electronic card 21 may be a processor, memory card, a substrate or any other type of electronic component that is known now, or discovered in the future.

In addition, the printed circuit board 29 may be a motherboard, or any other type of substrate that is known now or discovered in the future. The printed circuit board 29 may provide electrical connection between the electronic card 21 and other electronic components that are attached to the printed circuit board 29 (e.g., a processor).

The third and fourth set of electrical contacts 23C, 23D may have a variety of configurations. In some forms, the third and fourth set of electrical contacts 23C, 23D are configured to compress the electronic card 21 when the electronic card 21 is positioned between the third and fourth set of electrical contacts 23C, 23D.

The third and fourth set of electrical contacts may be configured to provide an electrical connection between the electronic card 21 and the printed circuit board 29. As an example, the third and fourth set of electrical contacts 23C, 23D may be electrically connected to different sets of electrical conductors on the printed circuit board 29 as compared to the electrical conductors that are connected to the first and second set of electrical contacts 23A, 23B.

In some forms, the ground shield 25 may include a first portion 28A that is between the first and third set of electrical contacts 23A, 23C. The ground shield 25 may further include a second portion 28B that is between the second and fourth set of electrical contacts 23B, 23D.

The first portion 28A of the ground shield 25 may be effective in providing isolation between the first and third set of electrical contacts 23A, 23C. In addition, the second portion 28B of the ground shield 25 may provide isolation between the second and fourth set of electrical contacts 23B, 23D.

In some forms, the first, second, third and fourth set of electrical contacts 23A, 23B, 23C, 23D are mounted to conductive pads 30 on the printed circuit board 29. In addition, the first and second portions 28A, 28B of the ground shield 25 may be mounted to ground pads 31 on the printed circuit board 29.

It should be noted that the conductive pads 30 on the printed circuit board 29 may be arranged in any configuration on the printed circuit board 29. As shown in FIGS. 1 and 3, the first, second, third and fourth set of contacts 23A, 23B, 23C, 23D may each be mounted to separate rows of the conductive pads 30 on the printed circuit board 29.

In some forms, the rows of conductive pads 30 may include opposing ends such that the ground pads 31 on the printed circuit board 29 may be adjacent to the opposing ends of the rows of conductive pads 30. It should be noted that the printed circuit board 29 may include more or less ground pads 31 and the ground pads 31 may be mounted in different locations on the printed circuit board 29 than are shown in FIGS. 1 and 3. The location of the ground pads 31 on the printed circuit board 29 will depend in part on the configuration of the first and second portions 28A, 28B of the ground shield 25 (among other factors).

Figure 4:
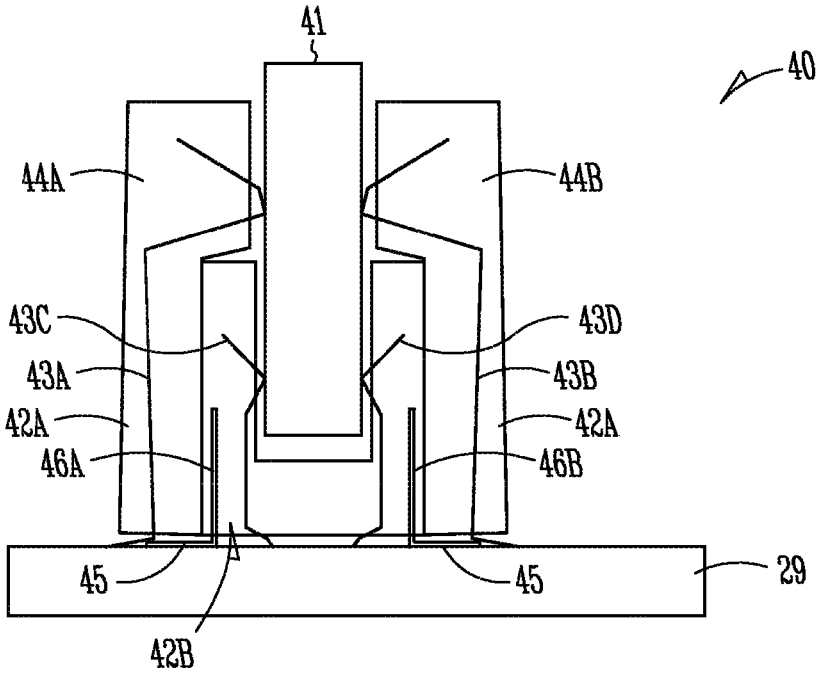
FIG. 4 is an end view of another example electronic assembly that includes the printed circuit board shown in FIG. 1.

FIG. 4 is an end view of another example of electronic assembly 40 that includes the printed circuit board 29 shown in FIG. 1. The electronic assembly 40 secures an electronic card 41.

The electronic assembly 40 includes an outer housing 42A that includes a first member 44A having a first set of electrical contacts 43A and a second member 44B having a second set of electrical contacts 43B. The first and second members 44A, 44B of the outer housing 42A are configured to receive the electronic card 41 between the first and second set of electrical contacts 43A, 43B.

The electronic assembly 40 further includes an inner housing 42B that includes a third set of electrical contacts 43C and a fourth set of electrical contacts 43D. The inner housing 42B is configured to receive the electronic card 41 between the third and fourth set of electrical contacts 43C, 43D. In other forms (not shown), the inner housing 42B may be formed of more than one member similar to the outer housing 42A.

The electronic assembly 40 further includes a ground shield 45 that is positioned between at least one of the first and third set of electrical contacts 43A, 43C and the second and fourth set of electrical contacts 43B, 43D. In some forms, the ground shield 45 is positioned between both of the first and third set of electrical contacts 43A, 43C and the second and fourth set of electrical contacts 43B, 43D.

The electronic assembly 40 may include an outer housing 42A and an inner housing 42B to facilitate manufacturing the electronic assembly 40 (among other factors).

As an example, the inner and outer housing 42A, 42B may each be formed of one piece or multiple pieces. In some forms, the inner and outer housing 42A, 42B may snapped together, integrally molded, press-fit and/or ultrasonically welded together. It should be noted that a variety of combinations of heat, pressure and ultrasonic energy may be used to secure the inner housing 42A to the outer housing 42B.

In the example form shown in FIG. 4, the inner housing is formed of two pieces. In addition, the outer housing is formed of two pieces.

In some forms, the inner and outer housing 42A, 42B may have a nested U-shape configuration. As an example, the inner housing 42A may be partially exposed from the outer housing 42B.

The inner housing 42A and the outer housing 42 may be formed of a thermoplastic material. It should be noted that the inner housing 42A and the outer housing 42 may be the same (or different) materials. Some example materials include liquid crystal polymers and high temperature nylons (among other potential materials).

The relative configurations of the outer housing 42A and the inner housing 42B will depend in part on a variety of factors, including but not limited to, (i) the size and shape of the first, second, third and fourth electrical contacts 43A, 43B, 43C, 43D; (ii) the size and shape of the electronic card 41; and/or (iii) the size and shape of the grounding shield 45 (among other factors). It should be noted that the outer housing 42A and the inner housing 42B may be made from the same (or different) materials.

The first and second set of electrical contacts 43A, 43B may have a variety of configurations. As an example, the first and second set of electrical contacts 43A, 43B may be configured to compress the electronic card 41 when the electronic card 41 is positioned between the first and second set of electrical contacts 43A, 43B. In addition, the first and second set of electrical contacts 43A, 43B may provide an electrical connection between the electronic card 41 and the printed circuit board 29.

The third and fourth set of electrical contacts 43C, 43D may have a variety of configurations. As an example, the third and fourth set of electrical contacts 43C, 43D may be configured to compress the electronic card 41 when the electronic card 41 is positioned between the third and fourth set of electrical contacts 43C, 43D. In addition, the third and fourth set of electrical contacts 43C, 43D may electrically connect the electronic card 41 to the printed circuit board 29 when the electronic card 41 is positioned between the third and fourth set of electrical contacts 43C, 43D.

The electronic card 41 may be similar to any of the electronic cards 21 described above, in addition, the printed circuit board 29 may be similar to any of the printed circuit boards 29 described above.

In some forms, the ground shield 45 includes a first portion 46A that is between the first and third set of electrical contacts 43A, 43C and a second portion 46B that is between the second and fourth set of electrical contacts 43B, 43D. The relative configurations of the first and second portions 46A, 46B will depend in part on the configurations of the first, second, third and fourth set of electrical contacts 43A, 43B, 43C, 43D (among other factors).

The first, second, third and fourth sets of contacts 43A, 43B, 43C, 43D may be mounted to conductive pads on the printed circuit board 29. In addition the first and second portions 46A, 46B of the ground shield 45 may be mounted to ground pads 31 on the printed circuit board 29.

The conductive pads 30 may be arranged on the printed circuit board 29 in a variety of configurations. As an example, the conductive pads 30 may be arranged in a plurality of rows that are side by side on the printed circuit board 29 (see, e.g., conductive pads 30 on the printed circuit board 29 shown in FIG. 1).

The ground pads 31 may be arranged in a variety of configurations on the printed circuit board 29. The arrangement of the ground pads 31 on the printed circuit board 29 will depend in part on the configuration of the first and second portions 46A, 46B of the ground shield 45 as well as the configurations of the first, second, third and fourth sets of contacts 43A, 43B, 43C, 43D (among other factors).

In some forms, the first, second, third and fourth sets of contacts 43A, 43B, 43C, 43D may each be mounted to separate rows of conductive pads 30 on the printed circuit board 29. In addition, the rows of conductive pads 30 may include opposing ends such that the ground pads 31 on the printed circuit board 29 are adjacent to the opposing ends of the rows of conductive pads 30.

The number, type and size of conductive pads 30 on the printed circuit board 29 will depend in part on the (i) type of electronic card 41 that is included in the electronic assembly 40; (ii) the number, type and size of the first, second, third and fourth sets of electrical contacts 43A, 43B, 43C, 43D that are included in the electronic assembly 40; and/or (iii) the size and configuration of the outer housing 42A and the inner housing 42B (among other factors). In addition, the number, type and size of the ground pads 31 on the printed circuit board 29 will depend in part on the number, type and size of the first, second, third and fourth sets of electrical contacts 43A, 43B, 43C, 43D as well as the configuration and size of the first and second portions 46A, 46B of the ground shield 45 (among other factors).

The first and second portions 46A, 46B of the ground shield 45 are embedded in the inner housing 42B. In other forms, the first and second portions 46A, 46B of the ground shield 45 may be embedded in the respective first and second members 44A, 44B of the outer housing 42A.

Other forms of the electronic assembly 40 are contemplated where the first and second portions 46A, 46B of the ground shield 45 are situated between the inner housing 42B and the outer housing 42A. The location of the first and second portions 46A, 46B of the ground shield 45 relative to the inner housing 42B and the outer housing 42A will depend in part on the manufacturing considerations that are associated with fabricating the electronic assembly 40 (among other factors).

As an example, one or more portions of the ground shield 45 may be electroplated onto surface(s) of the inner housing 42B and/or the outer housing 42A. The electroplating may involve masking one more sections of the inner housing 42B and the outer housing 42A.

Figure 5:
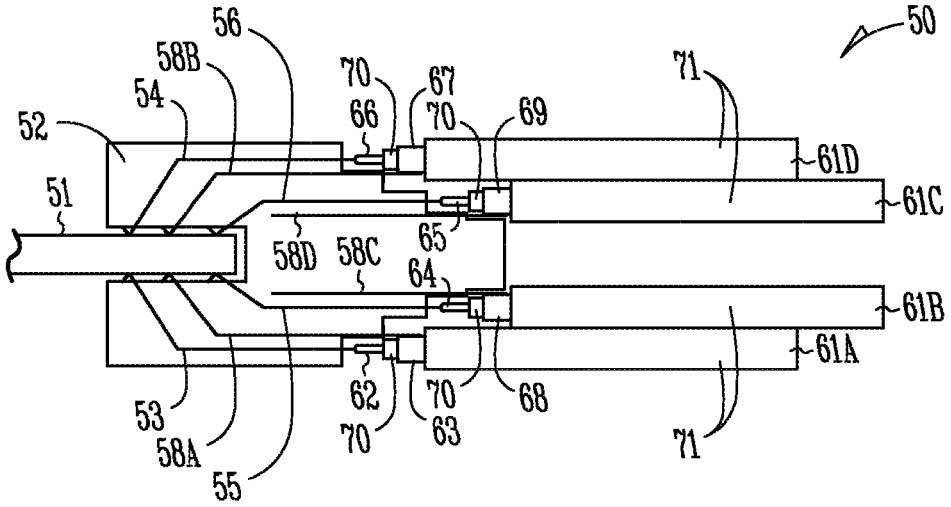
FIG. 5 is a schematic side view of another example electronic assembly.

FIG. 5 is a schematic side view of another example of electronic assembly 50. The electronic assembly 50 secures an electronic card 51.

The electronic assembly 50 includes a housing 52 that includes a first set of electrical contacts 53 and a second set of electrical contacts 54. The housing is configured to receive the electronic card 51 between the first and second set of electrical contacts 53, 54.

The housing 52 further includes a third set of electrical contacts 55 and a fourth set of electrical contacts 56. The housing 52 is configured to receive the electronic card 51 between the third and fourth set of electrical contacts 55, 56.

The housing 52 further includes a ground shield having a first portion 58A between the first and third set of electrical contacts 53, 55 and a second portion 58B between the second and fourth set of electrical contacts 54, 56.

The electronic assembly further includes a plurality of first cables 61A that each include a first signal conductor 62 and a first ground conductor 63. The first signal conductor 62 is electrically connected to the first set of electrical contacts 53 and the first ground conductor 63 is electrically connected to the first portion 58A of the ground shield.

The electronic assembly 50 further includes a plurality of second cables 61B that each include a second signal conductor 64. The second signal conductor 64 is electrically connected to the third set of electrical contacts 55.

The electronic assembly 50 further includes a plurality of third cables 61C that each include a third signal conductor 65. The third signal conductor 65 is electrically connected to the fourth set of electrical contacts 56.

The electronic assembly 50 further includes a plurality of fourth cables 61D that each include a fourth signal conductor 66 and a second ground conductor 67. The fourth signal conductor 66 is electrically connected to the second set of the electrical contacts 54 and the second ground conductor 67 is electrically connected to the second portion 58B of the ground shield.

In some forms, the ground shield may further include a third portion 58C that is between the third and fourth set of electrical contacts 55, 56 and a fourth portion 58D that is also between the third and fourth set of electrical contacts 55, 56. The first, second, third and fourth portions 58A, 58B, 58C, 58D of the ground shield may provide isolation between some, or all, of the first, second, third and fourth sets of electrical contacts 53, 54, 55, 56.

In some forms (not shown), the third portion 58C and the fourth portion 58D of the ground shield may be part of the electronic card 51. In those forms where the third portion 58C and the fourth portion 58D of the ground shield are part of the electronic card 51, the electronic card 51 may extend further between the plurality of second cables 61B and the plurality of third cables 61C to provide shielding between the plurality of second cables 61B and the plurality of third cables 61C.

In some forms, the plurality of second cables 61B may further include a third ground conductor 68 that is electrically connected to the third portion 58C of the ground shield. In addition, the plurality of third cables 61C may further include a fourth ground conductor 69 that is electrically connected to the fourth portion 58D of the ground shield. It should be noted that the configuration of the first, second, third and fourth portions 58A, 58B, 58C, 58D of the ground shield will depend in part on the number, type and size of the first, second, third and fourth sets of electrical conductors 53, 54, 55, 56 as well as the configuration and size of the housing 52 (among other factors).

In the example electronic assembly 50 shown in FIG. 5, the first, second, third and fourth plurality of cables 61A, 61B, 61C, 61D may be in alignment with one another, or partially overlapped in a somewhat stacked configuration. As an example, the first, second, third and fourth plurality of cables 61A, 61B, 61C, 61D may be aligned relative to one another.

As another example, the first and second cables 61A, 61B may be positioned on one side of the card 51 and in an overlapped (or offset) configuration. In addition, the third and fourth cables 61C, 61D may be positioned on an opposing side of the card 51 and in an overlapped (or offset) configuration.

As shown in FIG. 5, the first, second, third and fourth plurality of cables 61A, 61B, 61C, 61D may each include an insulating sleeve 70 that is between the respective signal conductors 62, 64, 65, 66 and the ground conductors 63, 67, 68, 69. In addition, the first, second, third and fourth plurality of cables 61A, 61B, 61C, 61D may each include an outer insulating layer 71.

The configuration and size of the first, second, third and fourth plurality of cables 61A, 61B, 61C, 61D will depend in part on (i) the number and type of electrical connections that need to be made with the electronic card 51; (ii) the number, type and arrangement of the first, second, third and fourth sets of electrical conductors 53, 54, 55, 56; and (iii) the number and type of the first, second, third and fourth portions 58A, 58B, 58C, 58D of the ground shield (among other factors).

FIGS. 1-5 are merely representational and are not drawn to scale. Certain proportions thereof may be exaggerated while others may be minimized.

The electronic assemblies described herein may provide a solution for supplying signals (e.g., high speed signals) between processors and electronic cards. The electronic assemblies described herein may also improve the reliability and overall system cost as compared to existing electronic assemblies where processors exchanges signals (e.g., high speed signals) with electronic cards. Many other embodiments will be apparent to those of skill in the art from the above description.

Figure 6:
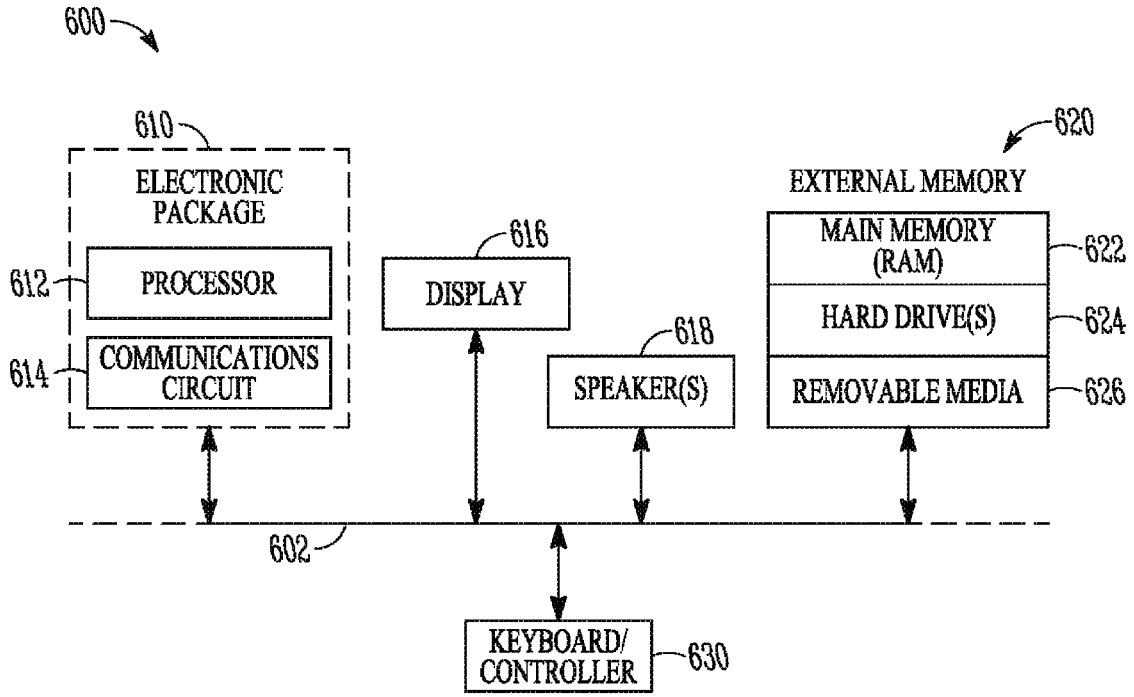
FIG. 6 is block diagram of an electronic apparatus that includes the electronic assemblies described herein.

FIG. 6 is a block diagram of an electronic apparatus 600 incorporating at least one electronic assembly described herein. Electronic apparatus 600 is merely one example of an electronic apparatus in which forms of the electronic assemblies described herein may be used. Examples of an electronic apparatus 600 include, but are not limited to, personal computers, tablet computers, mobile telephones, wearables, game devices, MP3 or other digital music players, etc.

In this example, electronic apparatus 600 comprises a data processing system that includes a system bus 602 to couple the various components of the electronic apparatus 600. System bus 602 provides communications links among the various components of the electronic apparatus 600 and may be implemented as a single bus, as a combination of busses, or in any other suitable manner.

An electronic assembly 610 as described herein may be coupled to system bus 602. The electronic assembly 610 may include any circuit or combination of circuits. In one embodiment, the electronic assembly 610 includes a processor 612 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that may be included in electronic assembly 610 are a custom circuit, an application-specific integrated circuit (ASIC), or the like, such as, for example, one or more circuits (such as a communications circuit 614) for use in wireless devices like mobile telephones, tablet computers, laptop computers, two-way radios, and similar electronic systems. The IC can perform any other type of function.

The electronic apparatus 600 may also include an external memory 620, which in turn may include one or more memory elements suitable to the particular application, such as a main memory 622 in the form of random access memory (RAM), one or more hard drives 624, and/or one or more drives that handle removable media 626 such as compact disks (CD), flash memory cards, digital video disk (DVD), and the like.

The electronic apparatus 600 may also include a display device 616, one or more speakers 618, and a keyboard and/or controller 630, which can include a mouse, trackball, touch screen, voice-recognition device, or any other device that permits a system user to input information into and receive information from the electronic apparatus 600.

To better illustrate the electronic assemblies disclosed herein, a non-limiting list of examples is provided here:

Example 1 includes electronic assembly for securing for an electronic card. The electronic assembly includes a housing that includes a first set of electrical contacts and a second set of electrical contacts, wherein the housing is configured to receive the card between the first and second set of electrical contacts, wherein the housing further includes a third set of electrical contacts and a fourth set of electrical contacts, wherein the housing is configured to receive the card between the third and fourth set of electrical contacts; and a ground shield positioned between at least one of the first and third set of electrical contacts and the second and fourth set of electrical contacts.

Example 2 includes the electronic assembly of example 1, wherein the ground shield includes a first portion between the first and third set of electrical contacts and a second portion between the second and fourth set of electrical contacts.

Example 3 includes the electronic assembly of any one of examples 1-2, wherein the first and second set of electrical contacts are configured to compress the card when the card is positioned between the first and second set of electrical contacts.

Example 4 includes the electronic assembly of any one of examples 1-3, wherein the third and fourth set of electrical contacts are configured to compress the card when the card is positioned between the third and fourth set of electrical contacts.

Example 5 includes the electronic assembly of any one of examples 1-4, and further including a printed circuit board, wherein the first, second, third and fourth sets of contacts are mounted to conductive pads on the printed circuit board and the first and second portions, of the ground shield are mounted to ground pads on the printed circuit board.

Example 6 includes the electronic assembly of any one of examples 1-5, wherein the first, second, third and fourth sets of contacts are each mounted to separate rows of conductive pads on the printed circuit board.

Example 7 includes the electronic assembly of any one of examples 1-6, wherein the rows of conductive pads include opposing ends such that the ground pads on the printed circuit board are adjacent to the opposing ends of the rows of conductive pads.

Example 8 includes an electronic assembly for securing for an electronic card. The electronic assembly includes an outer housing that includes a first member having a first set of electrical contacts and a second member having a second set of electrical contacts, wherein the outer housing is configured to receive the card between the first and second set of electrical contacts; an inner housing that includes a third set of electrical contacts and a fourth set of electrical contacts, wherein the inner housing is configured to receive the card between the third and fourth set of electrical contacts; and a ground shield positioned between at least one of the first and third set of electrical contacts and the second and fourth set of electrical contacts.

Example 9 includes the electronic assembly of example 8, wherein the ground shield includes a first portion between the first and third set of electrical contacts and a second portion between the second and fourth set of electrical contacts.

Example 10 includes the electronic assembly of any one of examples 8-9, wherein the first and second set of electrical contacts are configured to compress the card when the card is positioned between the first and second set of electrical contacts, and wherein the third and fourth set of electrical contacts are configured to compress the card when the card is positioned between the third and fourth set of electrical contacts.

Example 11 includes the electronic assembly of any one of examples 8-10, wherein the first member of the inner housing is secured with the first member of the outer housing and the second member of the inner housing is secured with the second member of the outer housing.

Example 12 includes the electronic assembly of any one of examples 8-11, wherein the first member of the inner housing is molded to the first member of the outer housing and the second member of the inner housing is molded to the second member of the outer housing.

Example 13 includes the electronic assembly of any one of examples 8-12, wherein the ground shield is between the inner housing and the outer housing.

Example 14 includes the electronic assembly of any one of examples 8-13, wherein the ground shield is between embedded within one of the inner housing and the outer housing.

Example 15 includes electronic assembly for securing for an electronic card. The electronic assembly includes a housing that includes a first set of electrical contacts and a second set of electrical contacts, wherein the housing is configured to receive the card between the first and second set of electrical contacts, wherein the housing further includes a third set of electrical contacts and a fourth set of electrical contacts, wherein the housing is configured to receive the card between the third and fourth set of electrical contacts, and wherein the housing further includes a ground shield having a first portion between the first and third set of electrical contacts and a second portion between the second and fourth set of electrical contacts; a plurality of first cables that each include a first signal conductor and a first ground conductor, wherein the first signal conductor is electrically connected to the first set of contacts and the first ground conductor is electrically connected to the first portion of the ground shield; a plurality of second cables that each include a second signal conductor, wherein the second signal conductor is electrically connected to the third set of contacts; a plurality of third cables that each include a third signal conductor, wherein the third signal conductor is electrically connected to the fourth set of contacts; and a plurality of fourth cables that each include a fourth signal conductor and a second ground conductor, wherein the fourth signal conductor is electrically connected to the second set of contacts and the second ground conductor is electrically connected to the second portion of the ground shield.

Example 16 includes the electronic assembly of example 15, wherein the ground shield includes a third portion between the third and fourth set of electrical contacts and a fourth portion between the third and fourth set of electrical contacts.

Example 17 includes the electronic assembly of any one of examples 15-16, wherein the plurality of second cables includes a third ground conductor that is electrically connected to the third portion of the ground shield.

Example 18 includes the electronic assembly of any one of examples 15-17, wherein the plurality of third cables includes a fourth ground conductor that is electrically connected to the fourth portion of the ground shield.

Example 19 includes the electronic assembly of any one of examples 15-18, wherein the first, second, third and fourth plurality of cables each include an insulating sleeve between the respective signal conductors and the ground conductors.

Example 20 includes the electronic assembly of any one of examples 15-19, wherein the first, second, third and fourth plurality of cables each include an outer insulating layer.

This overview is intended to provide non-limiting examples of the present subject matter—it is not intended to provide an exclusive or exhaustive explanation. The detailed description is included to provide further information about the systems, and methods.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An electronic assembly for securing an electronic card comprising:

a housing that includes a first set of electrical contacts and a second set of electrical contacts, wherein the housing is configured to receive the card between the first and second set of electrical contacts, wherein the housing further includes a third set of electrical contacts and a fourth set of electrical contacts, wherein the housing is configured to receive the card between the third and fourth sets of electrical contacts;

a ground shield embedded within the housing and positioned between at least one of the first and third sets of electrical contacts and the second and fourth sets of electrical contacts, wherein the ground shield includes a first portion between the first and third sets of electrical contacts and a second portion between the second and fourth sets of electrical contacts; and a printed circuit board, wherein the first, second, third and fourth sets of contacts are mounted to conductive pads on the printed circuit board and the first and second portions of the ground shield are mounted to ground pads on the printed circuit board, and wherein the first, second, third and fourth sets of contacts are each mounted to separate rows of conductive pads on the printed circuit board, wherein the rows of conductive pads include opposing ends such that the ground pads on the printed circuit board are adjacent to the opposing ends of the rows of conductive pads.

2. The electronic assembly of claim 1 wherein the first and second sets of electrical contacts are configured to corn press the card when the card is positioned between the first and second sets of electrical contacts.

3. The electronic assembly of claim 2 wherein the third and fourth sets of electrical contacts are configured to compress the card when the card is positioned between the third and fourth sets of electrical contacts.

4. An electronic assembly for securing an electronic card comprising:

an outer housing that includes a first member having a first set of electrical contacts and a second member having a second set of electrical contacts, wherein the outer housing is configured to receive the card between the first and second sets of electrical contacts;

an inner housing that includes a third set of electrical contacts and a fourth set of electrical contacts, wherein the inner housing is configured to receive the card between the third and fourth sets of electrical contacts;

a ground shield embedded within at least one of the inner housing and the outer housing, wherein the ground shield is positioned between at least one of the first and third sets of electrical contacts and the second and fourth sets of electrical contacts, wherein the ground shield includes a first portion between the first and third sets of electrical contacts and a second portion between the second and fourth sets of electrical contacts; and a printed circuit board, wherein the first, second, third and fourth sets of contacts are mounted to conductive pads on the printed circuit board and the first and second portions of the ground shield are mounted to ground pads on the printed circuit board, and wherein the first second, third and fourth sets of contacts are each mounted to separate rows of conductive pads on the printed circuit board, wherein the rows of conductive pads include opposing ends such that the ground pads on the printed circuit board are adjacent to the opposing ends of the rows of conductive pads.

5. The electronic assembly of claim 4 wherein the first and second sets of electrical contacts are configured to compress the card when the card is positioned between the first and second sets of electrical contacts, and wherein the third and fourth sets of electrical contacts are configured to compress the card when the card is positioned between the third and fourth sets of electrical contacts.

6. The electronic assembly of claim 5 wherein the first member of the inner housing is secured with the outer housing and the second member of the inner housing is secured with the outer housing.

7. The electronic assembly of claim 6 wherein the first member of the inner housing is molded to the first member of the outer housing and the second member of the inner housing is molded to the second member of the outer housing.

* * * * *